US005950154A

United States Patent [19]

Medaugh et al.

[11] Patent Number: 5,950,154

[45] Date of Patent: Sep. 7, 1999

[54] METHOD AND APPARATUS FOR MEASURING THE NOISE CONTENT OF TRANSMITTED SPEECH

[75] Inventors: Raymond Stephen Medaugh, Wharton; Ronald Shaya, Morristown, both of N.J.

[73] Assignee: AT&T Corp., Middletown, N.J.

[21] Appl. No.: 08/680,760

[22] Filed: Jul. 15, 1996

[51] Int. Cl.[6] ..... G10L 3/02; G10L 9/00

[52] U.S. Cl. ..... 704/226; 704/228; 704/233

[58] Field of Search ..... 704/226, 228, 704/233

[56] References Cited

U.S. PATENT DOCUMENTS

| | | | |
|---|---|---|---|
| 4,630,304 | 12/1986 | Borth | 704/226 |
| 4,897,878 | 1/1990 | Boll | 704/233 |
| 5,056,143 | 10/1991 | Taguchi | 704/219 |
| 5,646,991 | 7/1997 | Sih | 704/226 |
| 5,706,394 | 1/1998 | Wynn . | |
| 5,708,754 | 1/1998 | Wynn . | |
| 5,781,883 | 7/1998 | Wynn . | |

OTHER PUBLICATIONS

Lim, J.S., and Oppenheim. A.V., *Proceedings of the IEEE*, vol. 67, No. 12, Dec. 1979, Section V, pp. 1586–1604.

Hansen, J.H.L., Clements, M.A., *IEEE Transactions on Signal Processing*, vol. 39, No. 4, Apr. 1991, pp. 795–805.

*Primary Examiner*—David R. Hudspeth
*Assistant Examiner*—Robert Louis Sax

[57] ABSTRACT

A noise filter technique estimates noise in speech that has been processed by Call Multiplication Equipment. The received signal has speech frames and interspersed fill-noise frames inserted at a satellite signal receiving station. The filtering technique removes the fill-noise from the signal. The remaining speech frames are analyzed such that the speech frames having the lowest power values are used to create a histogram of power/frequency. This histogram contains information from which the noise-in-speech power spectrum is derived.

16 Claims, 7 Drawing Sheets

71
72
#pts
200
150
100
50
0
100
80
60
40
20
0
POWER (dB)
0
5
10
15
20
25
30
FREQ.

METHOD AND APPARATUS FOR MEASURING THE NOISE CONTENT OF TRANSMITTED SPEECH

BACKGROUND OF THE INVENTION

The present invention relates to enhancing the quality of speech in a noisy telecommunications channel when networked and particularly to an apparatus which enhances the speech by measuring the noise from the speech portions of the transmission itself and then removing the detected noise.

In all forms of voice communication systems, noise from a variety of causes can interfere with the user's communications. Corrupting noise can occur with speech at the input of a system, in the transmission path(s), and at the receiving end. The presence of noise is annoying or distracting to users, can adversely affect speech quality, and can reduce the performance of speech coding and speech recognition apparatus.

Noise in the transmission path is particularly difficult to overcome, one reason being that the noise signal is not ascertainable from its source. Therefore, suppressing it cannot be accomplished by generating an "error" signal from a direct measurement of the noise and then canceling out the error signal by phase inversion.

Various approaches to enhancing a noisy speech signal when the noise component is not directly observable have been attempted. A review of these techniques is found in "Enhancement and Bandwidth Compression of Noisy Speech," by J. S. Lim and A. V. Oppenheim, *Proceedings of the IEEE*, Vol. 67, No. 12, December 1979, Section V, pages 1586–1604. These include spectral subtraction of the estimated noise amplitude spectrum from the whole spectrum computed for the available noisy signal, and an interactive model-based filter proposed by Lim and Oppenheim which attempts to find the best all-pole model of the speech component given the total noisy signal and an estimate of the noise power spectrum. The model-based approach was used in "Constrained Iterative Speech Enhancement with Application to Speech Recognition," by J. H. L. Hansen and M. A. Clements, *IEEE Transactions On Signal Processing*, Vol. 39, No. 4, Apr. 1991, pages 795–805, to develop a non-real-time speech smoother, where additional constraints were imposed on the method of Lim/Oppenheim during the iterations to limit the model to maintain characteristics of speech.

Many noise detection techniques rely on detecting noise in the gaps between speech where the noise is the prominent signal. Thus, these techniques are easily employed in transmission systems in which both speech and gaps generated at the sender's end traverse the system. However, in the context of transmission systems that employ Call Multiplication Equipment, such as in satellite transmission systems, a unique problem arises. CME transmissions involve the sending of speech portions only. The gap portions are stripped away from the original signal by a speech detection algorithm. It is necessary to eliminate the gaps so as to maximize the use of the available bandwidth in the satellite arena. Thus, at the receiving end of the long distance transmission, the original speech gaps which contained useful noise information, and which were commonly used for measuring noise to be filtered from the speech portions, are no longer in existence. Instead, the receiving equipment inserts a different noise, referred to as fill noise. This fill noise adds an additional level of complexity to the noise measurement problem.

Therefore, it is desirable in the context of transmission systems where only speech portions are transmitted, to measure and filter out noise so as to improve the quality of speech at the receiving terminal.

SUMMARY OF THE INVENTION

The present invention provides a method and apparatus to measure the noise power spectrum from signals that contain noise plus speech. The measured noise can then be used in a known filtering technique to enhance speech quality if such a service is appropriate.

First, the receiving processing equipment receives a composite signal that includes speech subjected to CME processing and fill noise inserted between the reception point and the receiving processing point. The receiving processor identifies the fill noise contribution to the composite signal. The remaining signal is constituted by the speech frames of the composite signal. The present invention isolates a subset of these speech frames based on the power associated with the speech in each frame. The speech frames in the lowest 10 percentile with respect to power are analyzed by creating a two dimensional histogram where frequency and power dB are the two axes. The histogram value at frequency F and power P gives the number of times the speech power spectrum evaluated at frequency F (Hz) is of power P (dB). Frequency may be divided into N equal sized bins from zero to 4,000 Hz. In one embodiment there are 129 such bins. Also, power ranges can be divided into M values over a range of 100 dB to give an N by M histogram. The peak of histogram values at each frequency are used to determine the noise power spectrum. This noise power spectrum can then be used to filter out the noise from the composite signal.

The power threshold for determining the number of frames to be analyzed can be adjusted over time so as to provide a faster start up time at the beginning of the call to provide at least some minimal coarse filtering. Then after some period of time the system can settle down to select a reduced percentage of the speech frames.

DETAILED DESCRIPTION

The invention is essentially a noise power spectrum estimator when no separate noise reference is available. The invention will be described in connection with a telecommunications network and enhancing the quality of a received speech signal where the ability to enhance depends upon the measurement of the noise in the speech signal.

Figure 1A:
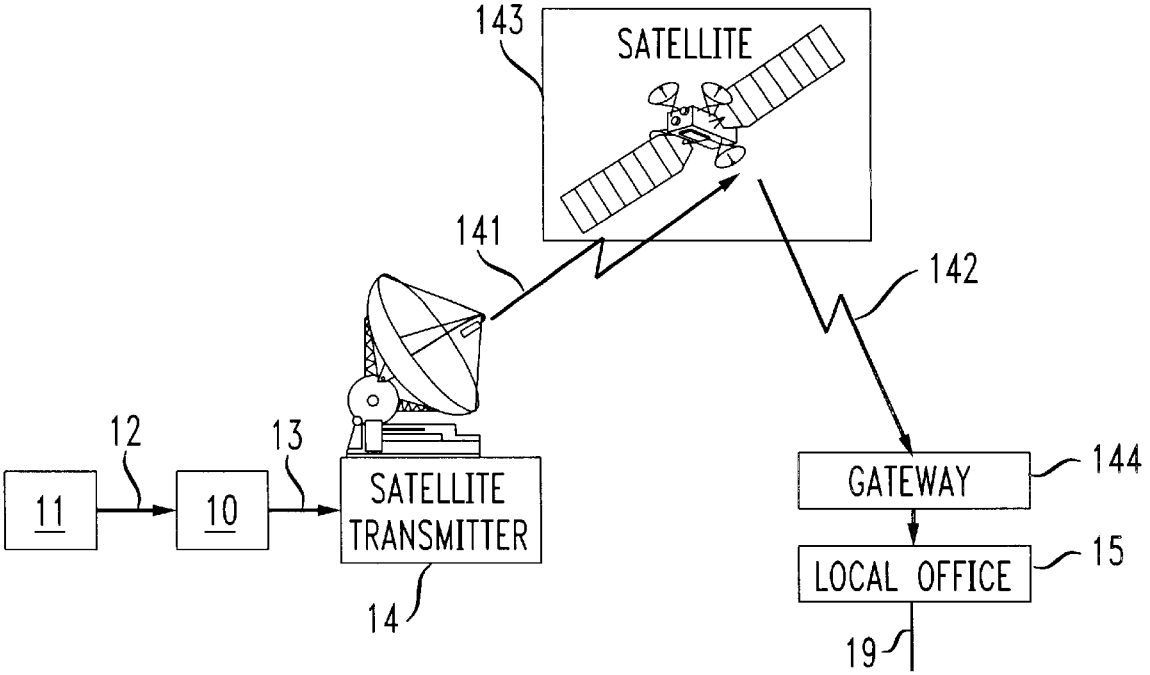
FIGS. 1A to 1C are block diagrams of a system in which an embodiment of the present invention may be deployed.

An exemplary telecommunications network is illustrated in FIG. 1A, constituting a remotely located switch 10 to which numerous communications terminals such as telephone 11 are connected over local lines such as 12. The local lines can be twisted pairs. Outgoing channels 13 emanate from the remote office 10. The outgoing channels may be connected to satellite transmitter 14 for transmitting the communications signal over a long distance. For instance, the remote communications terminal 11 could be located in India while the intended recipient of the communication is located in Los Angeles, Calif. In such a circumstance, the communication signal is transmitted via satellite 143 to a gateway 144 having satellite reception equipment. The transmitted signal consists of frames of data. This information is typically compressed by Call Multiplication Equipment (CME). The compression equipment transmits only the speech portions along the satellite transmission path. Therefore, the compression equipment does not transmit any speech gaps in which noise might be otherwise transmitted and more easily detected. In the illustrated embodiment the CME is employed in connection with a satellite transmission. However, the application of the present invention is not limited to the satellite environment. Instead, it is applicable wherever CME-like processing, (i.e., stripping out of speech gaps) is utilized.

At the receiving end the reception equipment in a gateway at the Boundary of the U.S. network and the international network inserts white noise into the speech gaps. The composite speech/fill noise signals are then transmitted to a U.S. based local office 15 for eventual transmission along transmission channel 19 to the intended recipient of the communication.

Figure 1B:
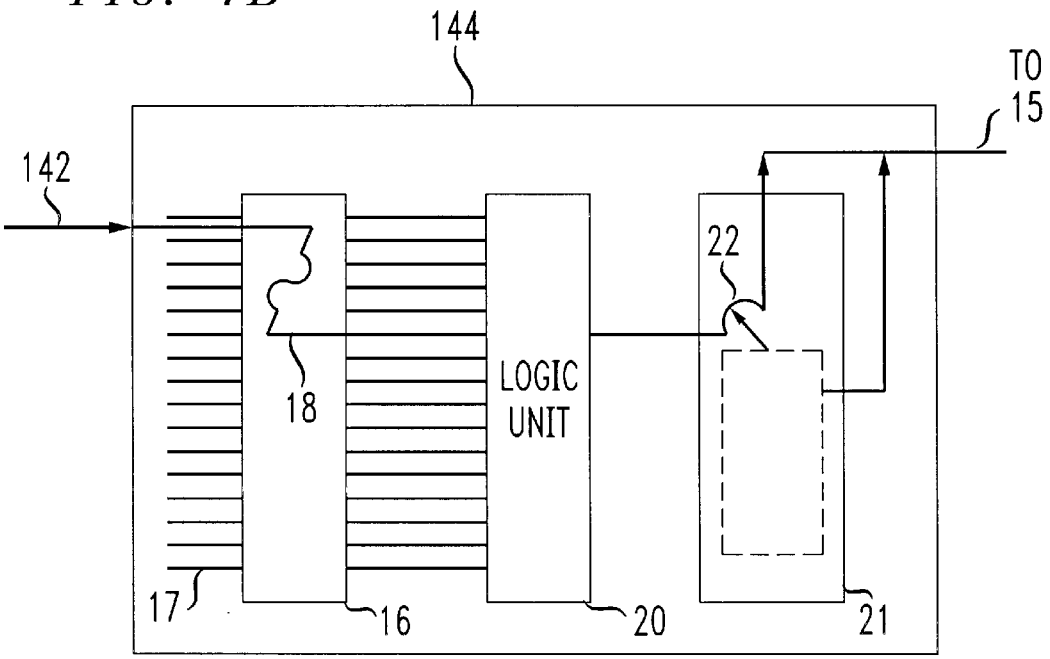

FIG. 1B illustrates an embodiment of a gateway in which the present invention may be deployed. In particular, a switch 16, sets up an internal path such as path 18 which, in the example, links an incoming call to an eventual outgoing transmission channel which is one of a group of outgoing channels. The incoming call is assumed to contain the noise generated in any of the segments of the linkage as well as the fill noise inserted by the reception equipment.

In accordance with the invention a logic unit 20 determines whether the call is voiced by ruling out fax, modem and other possibilities. Further, logic unit 20 determines whether the originating number or destination number is a customer of the transmitted noise reduction service. If logic unit 20 makes these determinations then the call is routed to a processing unit 21 by switch 22. Otherwise, the call is passed directly through to local office 15.

Figure 1C:
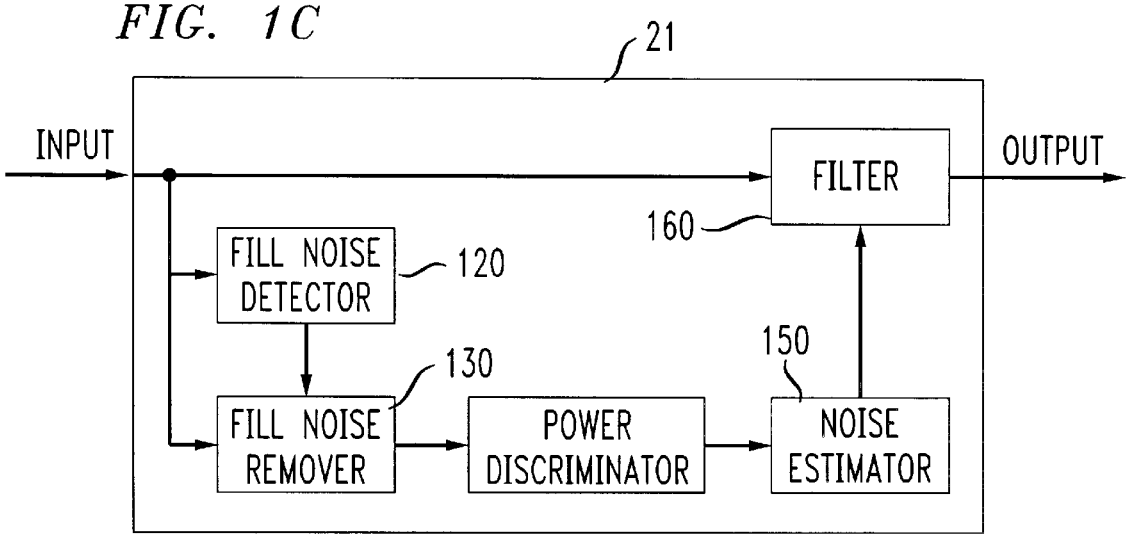

FIG. 1C illustrates in block diagram form an embodiment of the processing unit.

An input is provided to both a fill noise detector 120 and a fill noise remover 130. The fill noise detector operates in accordance with an algorithm described below to detect the fill noise signal added to the speech by the receiving equipment. A power discriminator 140 receives the speech frames from the fill noise remover 130 and determines the power distribution of the frames indicated to be speech. The discriminator selects, based on a predetermined threshold, for example 10%, those speech frames in the lowest power percentiles of the speech frames. These 10% of the speech frames in the present example are passed to the noise estimator 150. The noise estimator 150 then operates based upon an algorithm which is described below to measure the noise power spectrum of the noise in the speech itself. This noise estimation information is then provided to filter 160 which processes the composite signal prior to providing an output.

This is a dynamic process so that as further frames of information are provided in terms of composite signals this process is repeated so that these additional frames are subjected to fill noise filtering, power discrimination, and noise in speech estimation.

The problem that the present invention addresses and the general solution to the problem may be more easily understood by referring to FIGS. 2 to 7 of the application.

Figure 2:
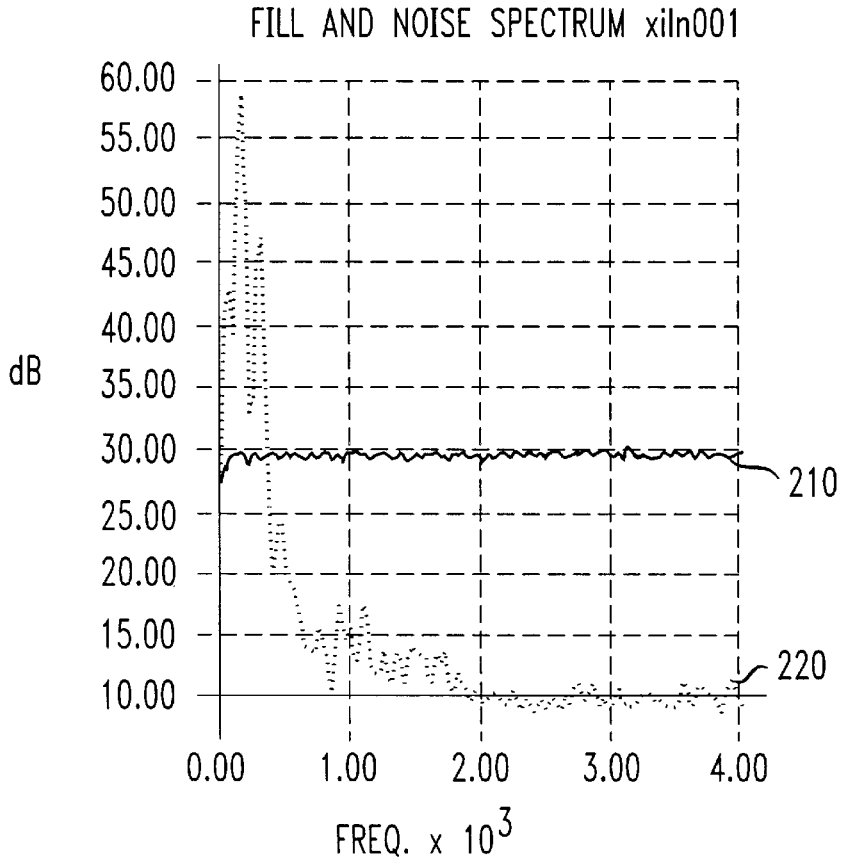
FIG. 2 illustrates a power versus frequency plotting of fill noise and noise-in-speech as an example of the problem solved by the present invention.

FIG. 2 illustrates an example of the power spectra for fill noise and noise in speech. As can be seen, the fill noise 210 is basically flat in nature, that is, it is rather constant in power over the entire frequency spectrum. However, in FIG. 2, an example of tonal noise is shown for the noise in speech. This tonal noise has strong components (40 to 60 dB) in the frequency range of 100 to 300 Hz. Thus, both of these noise components (fill and tonal) alternate in the input generated at the remote terminal and can have a negative impact on the ability of the receiver of the speech to discern the speech content. It is advantageous to minimize the effect of both of these noise sources on the speech content of the communication signal.

Figure 3:
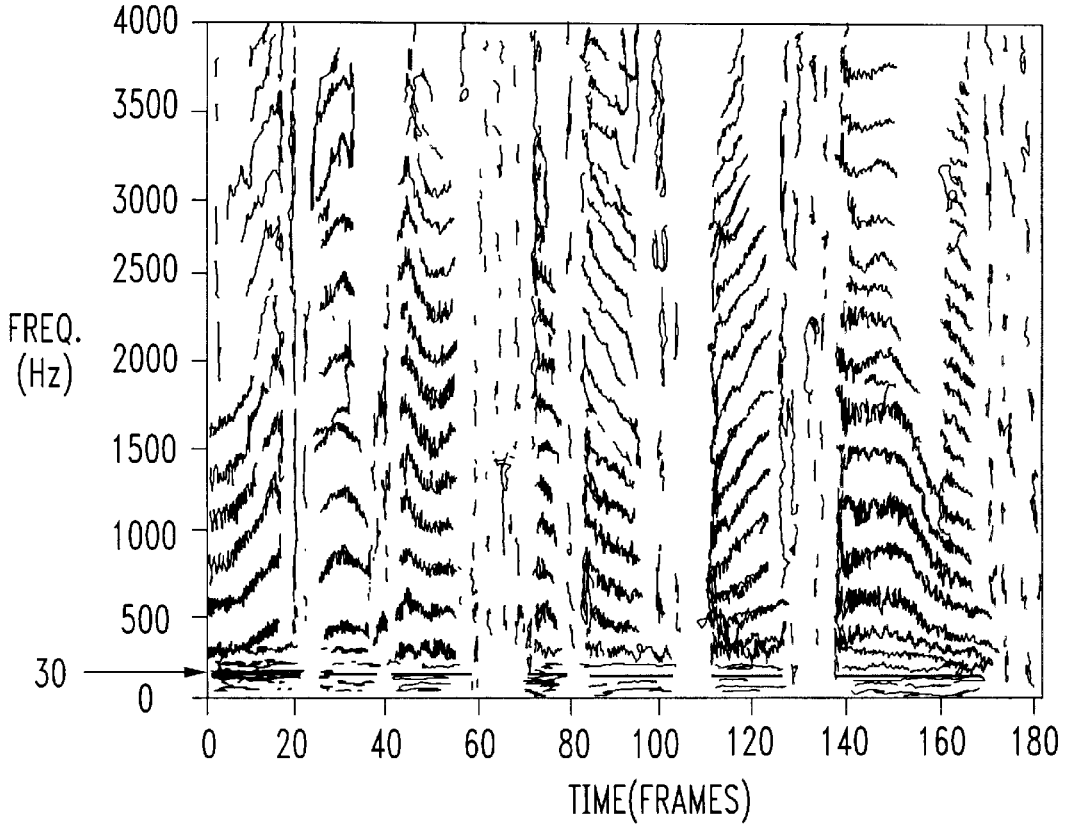
FIG. 3 illustrates a spectrogram of a composite signal of speech and noise as an example of the type of signal processed in the present invention.

FIG. 3 illustrates a spectrogram of a typical composite signal including speech and noise over a plurality of frames of the composite signal. It is apparent that at point 31 there is some influence from a rather stationary appearing signal. However, this information alone, while suggestive of tonal noise is not sufficient for generating the appropriate filters for the composite signal.

Figure 4:
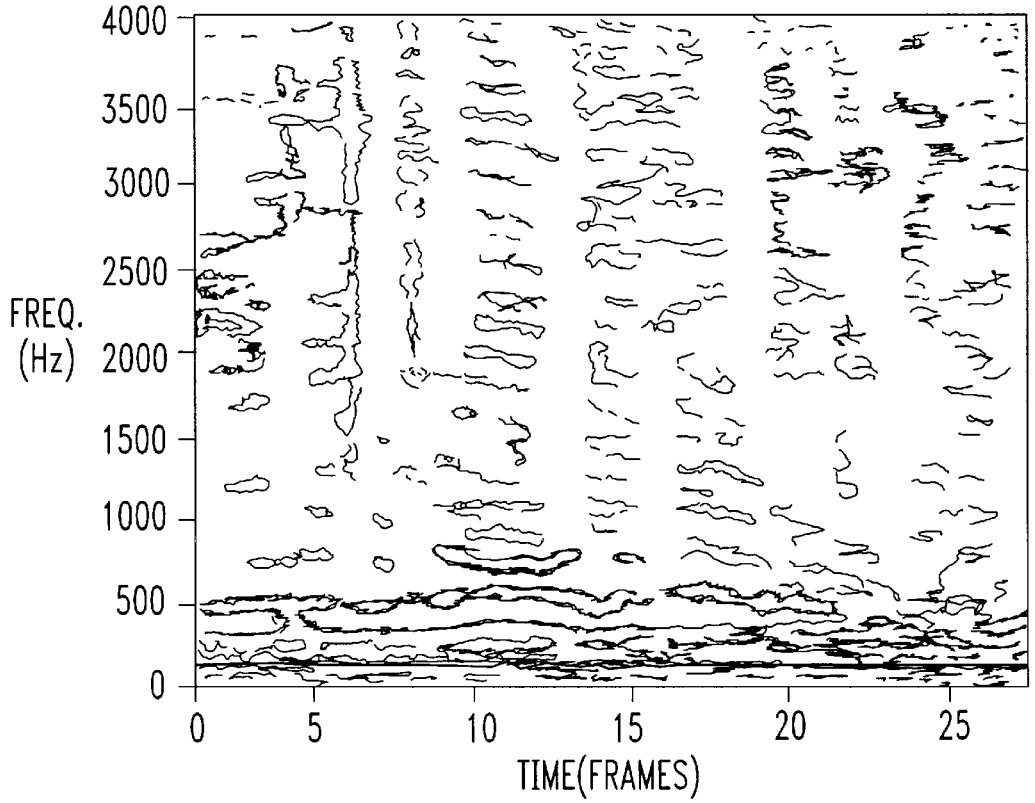
FIG. 4 illustrates a spectrogram of the lowest 10% of the speech based on the power associated with speech frames in the signal of FIG. 3.
Figure 5:
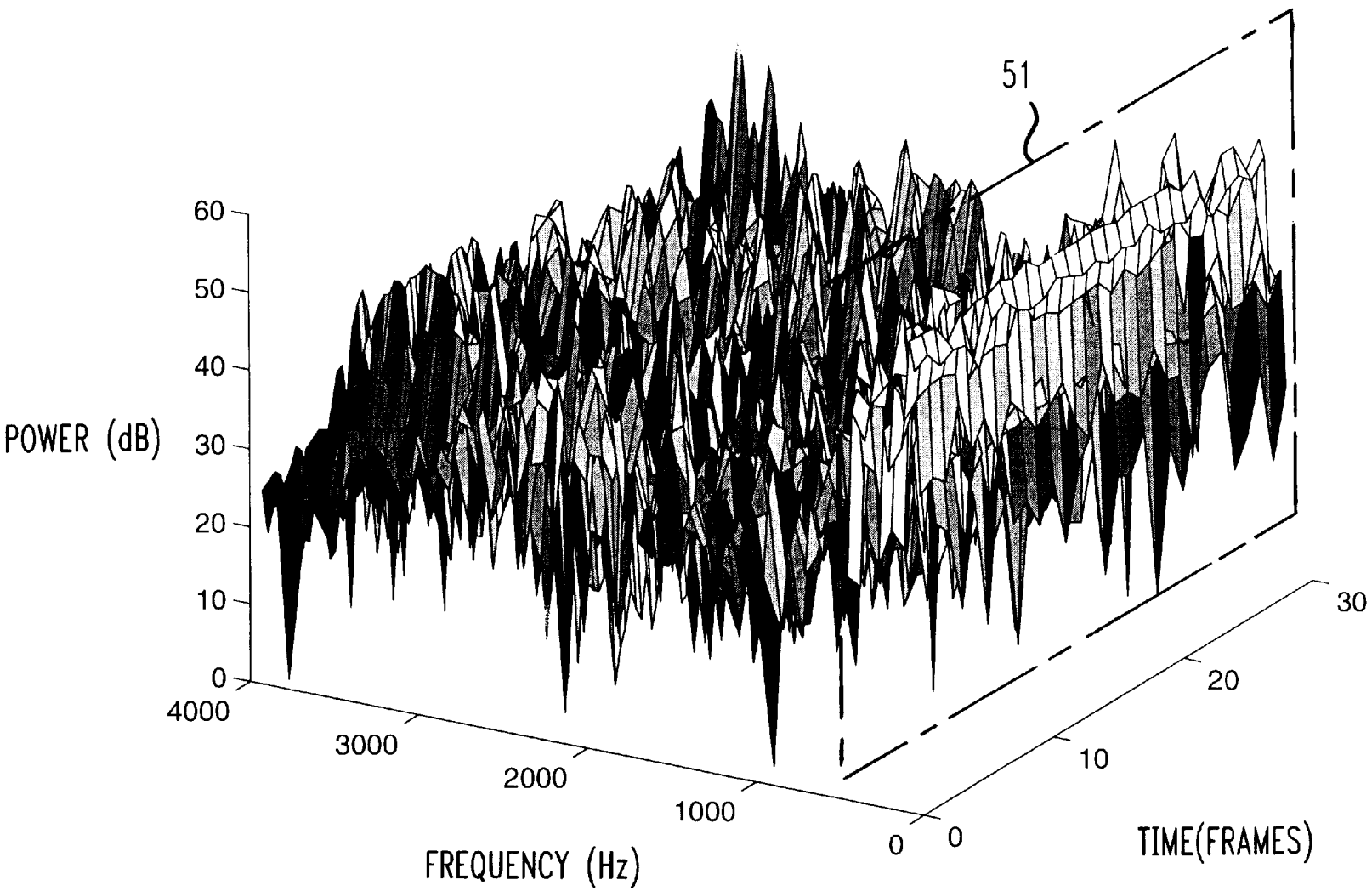
FIG. 5 provides a three-dimensional plot of the spectrogram of FIG. 4.

As discussed above in connection with FIG. 1C, an algorithm described in further detail below detects the fill noise content of the composite signal. The fill noise content can then be removed from the composite signal. In particular, the fill noise frames can be disregarded. Once the fill noise frames have been discarded only frames containing speech remain for purposes of measuring the noise power spectrum within the speech. The noise estimation algorithm works best by discriminating out a subset of those frames containing speech. In particular, in the present invention the algorithm determines an energy value for each speech containing frame and then determines a low power threshold point which determines that 10% of the speech frames have a power content lower than this low power threshold point. The process then uses only this 10% of the speech frames for analyzing whether and what noise can be found within the speech itself. FIG. 4 illustrates a spectrogram of this lowest 10% of the speech frames. The presence of noise versus speech in this spectrogram is hard to detect. However, when this spectrogram is converted into a three-dimensional plot as shown in FIG. 5 the presence of a noise "pattern" becomes more evident.

The three-dimensional plot displays frequency, the power of signals appearing at each frequency at each frame. It can be seen then that over a plurality of frames there is a fairly consistent presence of some signal at a power of approximately 50 dbs at some frequency near to 100 to 300 Hz as illustrated by the region designated 51 in FIG. 5.

Figure 6:
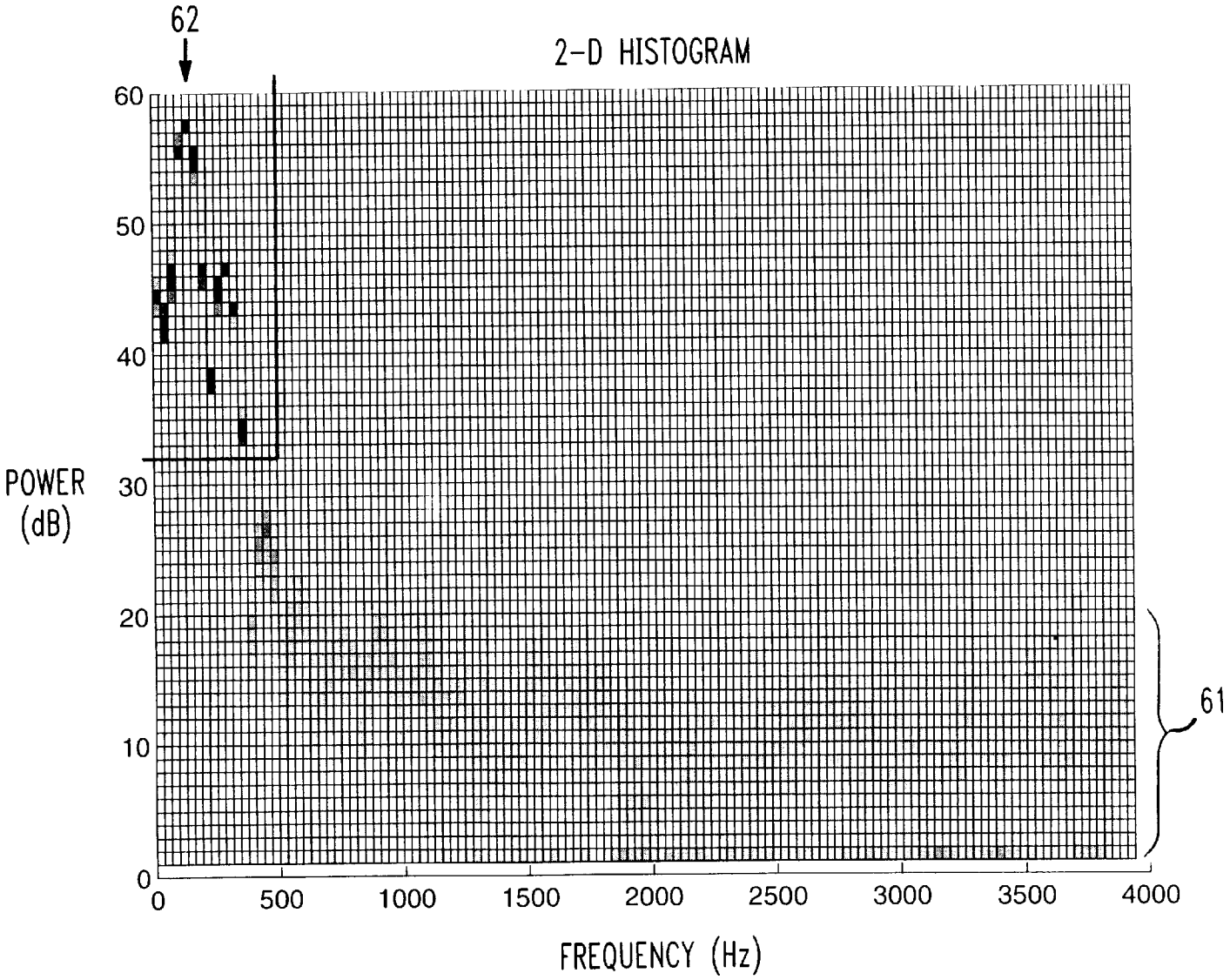
FIG. 6 illustrates a two-dimensional histogram generated from the three-dimensional spectrogram of FIG. 5.
Figure 7:
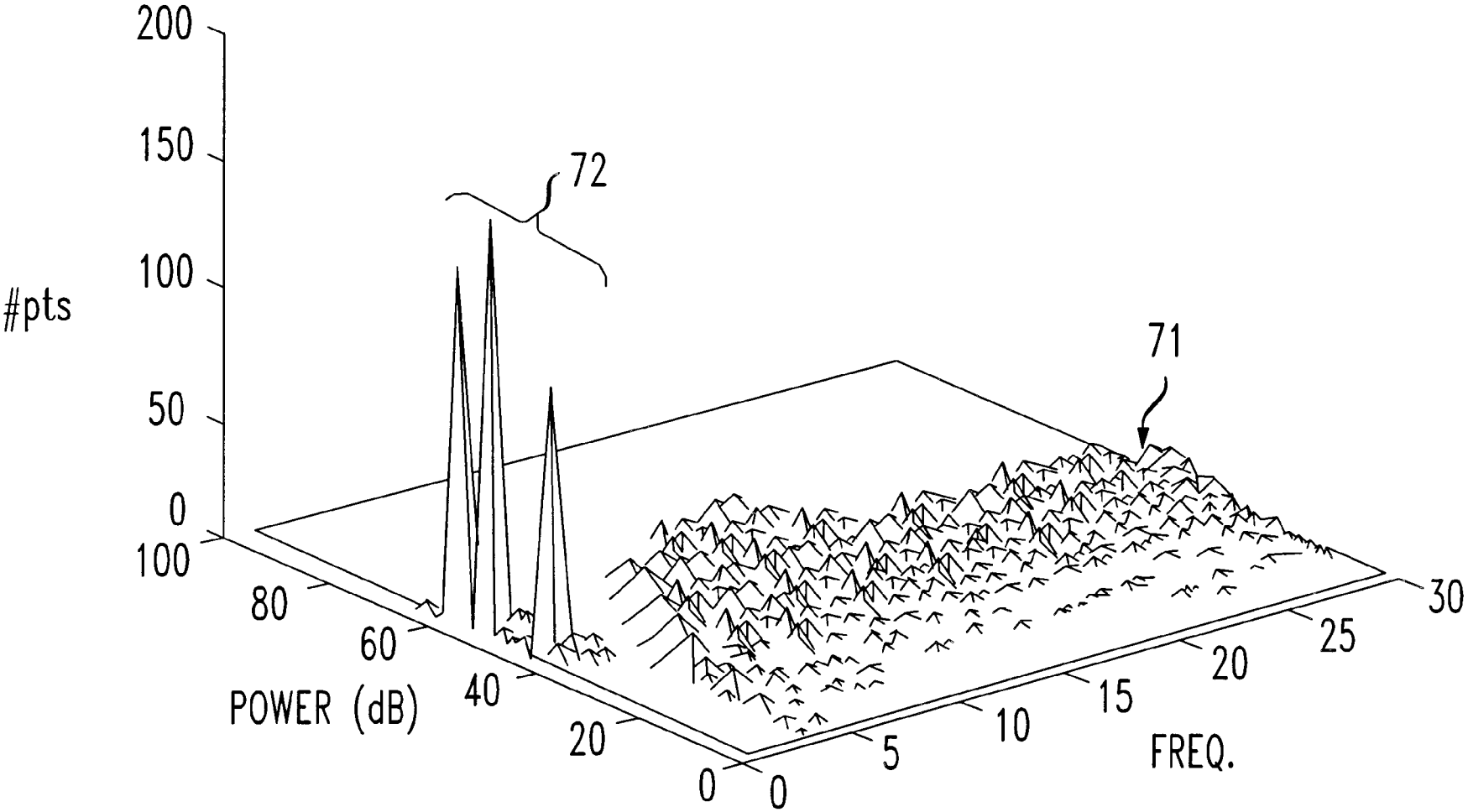
FIG. 7 illustrates a three-dimensional histogram containing the data represented by the two-dimensional histogram of FIG. 6.

A two-dimensional histogram is created showing, for each frequency and power cell, a gray level corresponding to the number of occurrences in the three-dimensional spectrogram. Such a two-dimensional histogram is illustrated in FIG. 6. It is clear that there is something of a more random distribution in the regions 61 at 20 dBs or lower from approximately 500 Hz to 4,000 Hz. However, there appears to be a more intense concentration of power/frequency combinations in the frequency range between 0 and 500 Hz and above 35 dB. The intensity of this correlation is better illustrated with reference to a three-dimensional histogram such as that shown in FIG. 7 of the present application.

Two general regions are designated in this three-dimensional histogram. The first region 71 basically illustrates the distribution of various speech portions of the speech frames across the frequency and power spectrum. The histogram shows the number of occurrences of a particular power and frequency combination over the prescribed number of frames. In region 71 the number of occurrences is fairly randomly distributed. However, in the region in which tonal noise exists, that is 50 to 300 Hz with the power of 40 to 60 dB, there is a strong concentration of frequency/power events and this is designated as region 72. This spiked region by its strength, that is the number of points or hits responding to these regions in the three-dimensional histogram, indicates the presence of tonal noise of this particular frequency and power distribution. Thus, this histogram information can now be utilized to characterize the noise-in-speech information which can in turn, be provided to the filtering equipment to generate the appropriate signal for enhancing the speech portion of the received composite signal. Thus, the recipient of the composite signal receives an improved quality signal with reduced impacts from the noise which might otherwise be generated by the transmission linkages between the generator of the speech and the recipient of the speech. The flows for determining the noise in speech content will now be described with reference to FIGS. 8 through 11.

Figure 8:
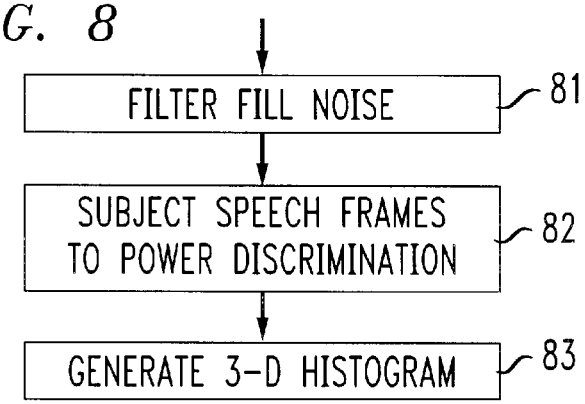
FIG. 8 illustrates a general three-step flowchart for detecting the noise in speech in accordance with the present invention.

FIG. 8 illustrates in general terms the three-step process in which the present invention measures the power spectrum of noise in speech. In a first step 81 the received speech is processed to determine the fill noise inserted between the speech. This is done using a bimodal detector and a repeating data detector as described below with respect to FIG. 9. Once the fill noise has been discarded from the composite signal the remaining frames are subjected to power discrimination, step 82 which is described in detail with respect to FIG. 10. That power discrimination selects a subset of the available speech frames based on an energy value associated with each speech frame so as to select those frames in which it is more possible to detect noise in speech because noise will play a bigger role or be a larger component of those frames. Following the step of power discrimination, a two-dimensional histogram is generated to identify frequency and power level bins which contain noise so that a noise power spectrum may be generated, step 83. The process for generating the histogram is described below with respect to FIG. 11.

Before proceeding with a description of the specific steps taken to process the composite signal a brief comment regarding the two-dimensional histogram is in order. In particular, in constructing the histogram the system uses a multiplicity of frequency/power bins for analyzing the content of the composite signal. In particular, the 0 to 4,000 Hz frequency range is divided into 129 frequency bins with a bin width of 31.25 Hz. The histogram is an array HIST [i] [j] in which the first subscript [i] is power in dB integer units ranging from 0 to 99 dB. The second subscript [j] is the frequency bin. Therefore, the value HIST [i] [j] is the number of times a frame has its jth frequency bin at a power level of idB. The goal of eliminating the fill noise is to reduce the impact of the fill noise on the histogram.

Figure 9:
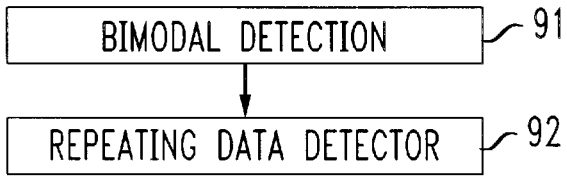
FIG. 9 illustrates a flowchart for detection of fill noise in a composite received signal.
Figure 10:
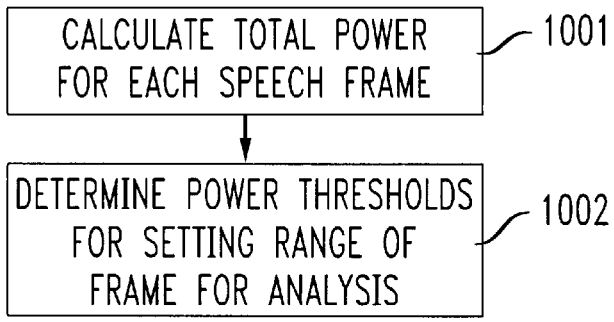
FIG. 10 illustrates a flowchart for power discrimination in a signal in which fill noise frames have been removed.
Figure 11:
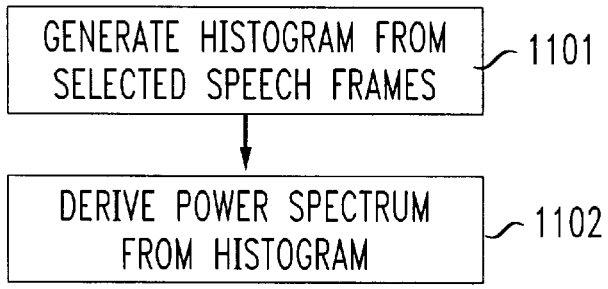
FIG. 11 illustrates a flowchart for generating a histogram from the power-discriminated speech frames in accordance with an embodiment of the present invention.

In the operation of fill noise detection illustrated by the flowchart of FIG. 9, the present invention provides two different detection operations, bi-modal detection and repeating data detection, to identify fill noise frames.

The composite speech is first subjected to bi-modal detection. In this detection operation the range from maximum sample level to minimum level of the frame is divided into three equal and contiguous regions. If the number of occurrences of sample level within the middle range is below a predefined threshold the frame is considered to be fill noise.

In a subsequent repeating data detector, the frame is examined to determine the number of samples p that match a maximum value and a number of samples q that match a minimum value. If the number p or q exceeds a predetermined threshold the frame is classified as fill.

Based on these two detectors those frames not classified as fill are provided for noise estimation processing.

The next step in the noise estimation operation regards power discrimination with respect to the frames remaining from the fill frame detection processes. This power discrimination operation involves selecting those speech frames from a block of speech frames which constitute the lowest predetermined percentage of speech frames based on the total power of each of the individual speech frames. Thus, as a first step the total power of each of the speech frames is calculated thereby giving a power band for each of the speech frames in the block of frames to be analyzed, step 1001. The processing unit then determines power threshold levels at which 10% of the speech frames have a total power associated therewith that falls between the determined thresholds, step 1002. This percentage can be adjusted to meet the processing needs of the filter. In fact, at start up, to reduce the amount of time necessary for some advantageous filtering capabilities to initiate, the threshold may be set as high as to permit analysis of the lowest 20% of the speech frames as determined by their respective power bands.

In one embodiment this determination of the power threshold that will determine which speech frames are subsequently processed, is determined in the following manner. The estimator must first determine a low threshold as a starting point for the frames to be analyzed. The estimator uses spectral flatness characteristics of the frames not identified as fill to determine that threshold. First there is a calculation of the ratio of a geometric mean to an arithmetic mean. To calculate flatness the operation first determines the power for each of the 129 frequency bins (step 91). The term "power (j)" corresponds to the power of the input spectrum, i.e., the spectrum of the input speech plus noise, at each frequency bin. A geometric power mean is calculated in accordance with equation 1.

$$geo = \left[\prod_{j=low}^{high} power(j)\right]^{\frac{1}{cnt}} \qquad \text{(Equation 1)}$$

and an arithmetic mean is calculated in accordance with equation 2.

$$arith = \frac{1}{cnt}\sum_{j=low}^{high} power(j) \quad \text{(Equation 2)}$$

Flatness is then calculated in accordance with equation 3 using the geometric and arithmetic means.

$$flatness = \frac{geo}{arith} \quad \text{(Equation 3)}$$

wherein cnt=high-low+1 low=10 high=100

Next, let numPts (M) be the number of frames with the total power dB=M±0.5. The average log flatness of frames with power dB=M, i.e., avFlat (M) is set to $$avFlat(M) = \frac{\sum_{frames\ of\ power\ M}^{10} \log_{10}(flatness)}{numPts(M)} \quad \text{(Equation 4)}$$

then, the starting point of a power threshold for determining the lowest 10% of the frames is set to the lowest power (lowPow) M such that the value calculated by equation 4 is less than a predetermined flat threshold. Then the term numNONFLAT is defined to be the number of frames where the flatness is greater than the flat threshold. Then the high range determinant, highPow, is calculated to be the lowest power for which 10% of the nonflat speech frames are of less than highPow but greater than lowPow. Thus, this power discrimination operation selects the lowest 10% of the spectrally nonflat speech frames based on the power characteristics of the speech frame. The rationale for selecting this subset of speech frames is that the noise will be more prominent and more easily estimated within this group of speech frames.

Having completed the discrimination of the speech frames, the present invention then determines the noise power spectrum within the speech frames by first generating a histogram that correlates frequency and power in the selected speech frames (step 1101) and then a noise power spectrum is derived from the histogram.

A two-dimensional histogram such as that shown in FIG. 6 is derived from these selected frames, that is the frames which contain speech and have total power values lower than the highPOW threshold. The number of frames in generating the histogram is 200 although this number can be reduced substantially, for example to 71 frames, for the first histogram so that the system begins to provide some noise detection and hence filtering early on in the communication.

As described above, the histogram is an array HIST [i] [j] in which the first subscript [i] is power in dB integer units ranging from 0 to 99 and the second subscribe [j] is the frequency bin which ranges from 0 to 128 with a bin width of 31.25 Hz. HIST [i] [j] is the number of times the frame has its jth frequency bin at a power level of idB. The noise power spectrum is generated in the following manner. For each frequency [j] the maximum of HIST [i] [j], designated max [j] is derived over all [i]. The power I of the maximum in this detection operation is designated as Imax [j]. In addition to the maximum for each frequency bin j, the local maximum Imax low [j] is derived as the lowest power level where a local maximum occurs of a level greater than a threshold which in the present embodiment is set at 8. For each frequency bin j the power spectrum level is estimated to be for 3<j<30 if max[j]<25 and imax Low [j]<imax[j]−4 then power[j]=imaxLow[j] else power[j]=imax[j]. For j≦3 or j≧30 power[j]=imax[j].

This delineation prevents formant frequency levels from being used in the noise power level. Levels above 25 are assumed to be tonals while peaks below 25 are assumed to be formants for frequencies 93 to 930 Hz. The above calculation is done one frequency bin J per 10 msecs. Therefore, the calculation is completed 1.29 seconds after the histogram is completed.

These are exemplary calculations for executing the effective noise detection of the present invention. These specific calculations may be modified so long as the core information is still obtained from the composite speech signals, namely the fill noise information for permitting only selected portions of the composite signal to be analyzed for noise, namely the speech portions; and the selection of a subset of the speech frames to improve the detectibility of the noise power spectrum. Therefore, this same technique can be used to detect "white noise" or "colored noise" in the composite signal as well. The only difference is that the appearance of this white noise in the histogram will not be as pronounced as in the case of tonal noise.

The present invention enables the estimation of noise in transmission systems in which the portion of the signal traditionally analyzed for noise, that is the gap or silence portions, have been eliminated or modified, such as in those systems that employ CME or Time-Assignment Speech Interpolation (TASI). Thus, the present invention permits the improvement of speech reception even where traditional noise estimation and filtering techniques are unavailable.

What is claimed is:

1. A method for estimating a noise spectrum in speech frames received in a telecommunications transmission, comprising the steps of:

determining power characteristics for each of a first plurality of speech frames;

selecting a subset of said first plurality of speech frames based on the determined power characteristics and a power threshold whereby each speech frame in said subset has a power characteristic below said power threshold;

generating a histogram correlating frequency and power in said subset of said first plurality of speech frames; and approximating a noise power spectrum in said first plurality of speech frames from said histogram.

2. The method of claim 1, comprising the further steps of:

defining a second plurality of speech frames, subsequent in time to said first plurality of speech frames in the transmission;

determining the power characteristics for each of said second plurality of speech frames;

selecting a subset of said second plurality of speech frames based on the determined power characteristics and a second power threshold whereby each speech frame in said subset has a power characteristic below said second power threshold;

generating a histogram correlating frequency and power in said subset of said second plurality of speech frames; and approximating a noise spectrum in said second plurality of speech frames from said histogram.

3. The method of claim 2, wherein a number of speech frames in said first plurality of speech frames is fewer than a number of speech frames in said second plurality of speech frames.

4. The method of claim 1, further comprising the step of detecting speech frames in the telecommunications transmission by extracting fill-noise frames from the transmission.

5. The method of claim 1, wherein the said step of generating of a histogram comprises the substeps of analyzing each speech frame of said subset of first plurality of speech frames wherein a power is detected for each frequency subrange in a plurality of subranges constituting the frequency range of interest.

6. A method for estimating noise in received transmission signals produced by Call Multiplication Equipment and containing fill-noise comprising the steps of:

deleting the fill-noise from the received transmission signal to isolate a communication signal of interest;

selecting a portion of said communication signal of interest using energy characteristics of said communication signal of interest so as to have a selected portion in which the energy characteristics are below a determined threshold;

approximating a noise power spectrum in the received transmission signals based on power and frequency characteristics of the selected portion of said communication signal of interest.

7. The method of claim 6, wherein said step of approximating includes generating a histogram correlating frequency and power in subportions of said portion of said communication signal of interest.

8. The method of claim 6, wherein the received transmission signal comprises a plurality of speech frames and a plurality of fill-noise frames and said step of selecting comprises the step of isolating a predetermined percentage of said speech frames in accordance with the energy level of each speech frame.

9. The method of claim 6, wherein said portion of said communication signal of interest constitutes a plurality of speech frames.

10. The method of claim 9, wherein said step of approximating includes generating a histogram correlating frequency and power in subportions of the isolated speech frames.

11. A system for improved speech signal transmission and reception comprising:

call multiplication equipment generating a transmission signal from an input speech signal;

a transmitter at a first location and coupled to said call multiplication equipment;

a receiver at a second location, remote from said first location and including a fill-noise generator; and call processing equipment coupled to said receiver and receiving a composite speech signal that includes speech and fill-noise, wherein said call processing equipment includes, a fill-noise detector extracting fill-noise portions from the composite speech signal;

power discriminator coupled to said fill-noise detector to select speech portions of said composite speech signal having energy values below a determined threshold; and a noise-in-speech detector coupled to said power discriminator so as to receive the speech portions selected based on energy values.

12. The system of claim 11, wherein said selected speech portions constitute a plurality of speech frames and wherein said power discriminator includes means for adjusting the number of speech frames constituting said plurality of speech frames.

13. The system of claim 11, wherein said selected speech portions constitute a plurality of speech frames and wherein said noise-in-speech estimator comprises:

means for determining a power value for each frequency sub-range in a plurality of frequency sub-ranges in a signal frequency range of interest for each of said plurality of speech frames; and means for generating a histogram identifying frequency ranges and the number of occurrences of a particular power value associated with each of those frequency ranges over the plurality of speech frames.

14. The system of claim 13, wherein said noise-in-speech detector comprises:

means for determining a power value for each frequency sub-range in a plurality of frequency subranges in a signal frequency range of interest for each of said plurality of speech frames; and means for generating a histogram identifying frequency ranges and the number of occurrences of a particular power value associated with each of those frequency ranges over the plurality of speech frames.

15. An apparatus for call processing comprising:

an input port;

an output port;

an internal switch coupled to said input port;

means for determining whether a transmission signal received at said input port is entitled to noise processing;

a noise processing unit having an input coupled to said internal switch and including, a fill-noise detector receiving said input;

a noise-in-speech estimator coupled to said fill-noise filter; and a filter, coupled to said noise-in-speech estimator and to said output port.

16. The apparatus of claim 15, wherein said noise-in-speech estimator comprises:

a power discriminator coupled to said fill-noise filter and selecting speech portions of an input speech signal, the selected speech portions constituting a plurality of speech frames;

means for determining a power value for each frequency sub-range in a plurality of frequency subranges in a signal frequency range of interest for each of said plurality of speech frames; and means for generating a histogram identifying frequency ranges and the number of occurrences of a particular power value associated with each of those frequency ranges over the plurality of speech frames.

* * * * *